US008783906B2

(12) United States Patent
Best et al.

(10) Patent No.: US 8,783,906 B2
(45) Date of Patent: Jul. 22, 2014

(54) SOLID STATE OUTDOOR OVERHEAD LAMP ASSEMBLY

(75) Inventors: Shawn R. Best, Tampa, FL (US); Robert Fugerer, Lutz, FL (US); Donald VanderSluis, Sarasota, FL (US); Daniel Puccio, Venice, FL (US); John LaCorte, Venice, FL (US)

(73) Assignee: Evolucia, Inc., Sarasota, FL (US)

( * ) Notice: Subject to any disclaimer, the term of this patent is extended or adjusted under 35 U.S.C. 154(b) by 122 days.

(21) Appl. No.: 13/089,184

(22) Filed: Apr. 18, 2011

(65) Prior Publication Data

US 2012/0025711 A1 Feb. 2, 2012

Related U.S. Application Data

(60) Provisional application No. 61/325,116, filed on Apr. 16, 2010.

(51) Int. Cl.

| | |
|---|---|
| ***F21S 4/00*** | (2006.01) |
| ***F21V 21/00*** | (2006.01) |
| ***F21V 1/00*** | (2006.01) |
| ***H05B 37/00*** | (2006.01) |
| ***H05B 39/00*** | (2006.01) |
| ***H05B 41/00*** | (2006.01) |

(52) U.S. Cl.
USPC ..... 362/249.02; 362/158; 315/312

(58) Field of Classification Search
USPC ..... 315/312; 362/235, 249.02, 184
See application file for complete search history.

(56) References Cited

U.S. PATENT DOCUMENTS

| | | | | |
|---|---|---|---|---|
| 6,682,211 | B2 * | 1/2004 | English et al. | 362/545 |
| 7,278,761 | B2 * | 10/2007 | Kuan | 362/294 |
| 7,347,706 | B1 * | 3/2008 | Wu et al. | 439/320 |
| 8,118,450 | B2 * | 2/2012 | Villard | 362/249.02 |
| 2008/0212329 | A1 | 9/2008 | Duguay | |
| 2009/0213588 | A1 * | 8/2009 | Manes | 362/235 |
| 2009/0303715 | A1 | 12/2009 | Takasago | |
| 2009/0316403 | A1 | 12/2009 | Zhang | |
| 2009/0323343 | A1 | 12/2009 | Wang | |
| 2010/0073932 | A1 | 3/2010 | Zheng | |
| 2010/0134046 | A1 * | 6/2010 | Holder et al. | 315/297 |
| 2010/0315813 | A1 * | 12/2010 | Fugerer et al. | 362/235 |
| 2011/0013397 | A1 * | 1/2011 | Catone et al. | 362/244 |
| 2011/0187273 | A1 * | 8/2011 | Summerford et al. | 315/152 |

(Continued)

FOREIGN PATENT DOCUMENTS

| | | | |
|---|---|---|---|
| CN | 201014270 | Y | 1/2008 |
| CN | 101520143 | A | 9/2009 |

(Continued)

*Primary Examiner* — Alexander H Taningco
*Assistant Examiner* — Dylan White
(74) *Attorney, Agent, or Firm* — Holland & Hart LLP

(57) ABSTRACT

An outdoor overhead lamp assembly uses light emitting diodes to provide illumination for an area to be illuminated. The lamp assembly includes a unitary housing, which may be formed from a single casting. The housing includes mechanical mounting structure for mounting the housing to a mast arm. The housing includes an electrical compartment for housing electrical components and connections. Heat sink fins are formed on the integral housing that provide for thermal control of the electronic components and LED modules within the lamp assembly. The LED modules are mounted to aiming platforms within an optical compartment for the assembly. An external lens provides environmental protection for the LEDs and their individual lenses. The housing may also include structures for mounting decorative coverings or "skins" to accommodate different aesthetic requirements.

11 Claims, 7 Drawing Sheets

(56) References Cited

U.S. PATENT DOCUMENTS

| | | | | |
|---|---|---|---|---|
| 2011/0188233 | A1* | 8/2011 | Josefowicz et al. | 362/158 |
| 2012/0026728 | A1* | 2/2012 | Lou et al. | 362/217.05 |
| 2012/0262917 | A1* | 10/2012 | Courcelle | 362/235 |
| 2012/0262922 | A1* | 10/2012 | Yang et al. | 362/268 |

FOREIGN PATENT DOCUMENTS

| | | | |
|---|---|---|---|
| EP | 1431653 | A2 | 6/2004 |
| EP | 2123972 | A1 | 11/2009 |
| GB | 2457971 | A | 9/2009 |
| JP | 2007-311064 | A | 11/2007 |
| JP | 3141757 | | 4/2008 |
| JP | 2008210711 | A2 | 9/2008 |
| JP | 3150841 | | 5/2009 |
| JP | 3153544 | | 9/2009 |
| KR | 2007-0058728 | A | 6/2007 |
| KR | 2009-0000762 | U | 1/2009 |
| KR | 2009-0101687 | A | 9/2009 |
| WO | 2009052093 | A1 | 4/2009 |

* cited by examiner

SOLID STATE OUTDOOR OVERHEAD LAMP ASSEMBLY

CROSS-REFERENCE TO RELATED APPLICATIONS

This application claims priority to U.S. Provisional Patent Application No. 61/325,116, entitled "Solid State Outdoor Overhead Lamp Assembly," filed on Apr. 16, 2010, the disclosure of which is incorporated herein by reference in its entirety.

FIELD

The present application is directed to outdoor overhead lamp assemblies and, more specifically, to outdoor overhead lamp assemblies containing light emitting diode light sources mounted to faceted surfaces of a cast housing.

BACKGROUND

Street lighting with overhead street lights (referred to also as luminaires) is used throughout the United States, and the world, to provide lighting in desired areas for enhanced visibility when it is dark outside. Overhead lights are used in numerous applications, in addition to street lighting, such as parking lots, walkways, and open areas, for example. One common type of overhead light is known as a "cobra head." Existing cobra head luminaires are virtually ubiquitous, comprising the bulk of the utility street lighting in the United States. They may use low-pressure sodium, high-pressure sodium, metal halide, or high-pressure mercury lamps. Next generation lighting technologies, particularly solid state lighting, hold forth the promise of greater efficiency, longer lifetime and lower maintenance than traditional lamps. This generally holds true only if the luminaire design is well suited to optimal utilization of solid-state lighting technologies, specifically LEDs—Light Emitting Diodes.

In order to efficiently utilize the salient characteristics of LEDs, a luminaire must be designed to direct the light from multiple LEDs in the desired pattern, provide heat sinking to keep the LEDs at a sufficiently cool operating temperature, be able to be mounted to existing standard pole structures and provide architects, designers, municipalities and others the ability to select a visual design that fulfills the aesthetic requirements of their particular installation.

SUMMARY

The present disclosure provides embodiments that fulfill the functional requirements as discussed above, among others, in a unitary housing that can be utilized as manufactured or have decorative additions readily attached to fulfill specific aesthetic requirements.

In one aspect, the present disclosure provides an overhead street luminaire apparatus, comprising: a unitary housing comprising a mechanical mounting structure, an electrical compartment; a plurality of heat dissipation devices; and a plurality aiming platforms; a plurality of light emitting diode (LED) modules, each mounted to an aiming platforms; and a control module located within the electrical compartment and coupled to the LED modules, and configured to control the operation of the LED modules. In some embodiments, a decorative covering mounted to the unitary housing. The decorative covering may include one or more secondary light emitting diodes that are coupled to the control module, with the control module is further configured to control the operation of the secondary light emitting diodes. The control module may be configured to be programmed to cause the secondary light emitting diodes to activate and deactivate in a predetermined sequence. A controller interface may be coupled to the control module and receive programming instructions for the control module. In some embodiments, the controller interface is adapted to receive programming instructions via a wireless communications interface.

In some embodiments, the unitary housing comprises a housing formed of a single casting. Such a single casting may be, for example, an aluminum casting. The heat dissipation devices may comprise a plurality of transversely oriented heat dissipation fins. The LED modules may be mounted to the aiming platforms with a heat conducting epoxy, with the aiming platforms connected to the heat dissipation devices, thereby providing a conductive thermal path between the LED modules and the heat dissipation devices.

In further embodiments, the housing furhter comprises an optical compartment in a cavity of the housing, adjacent to the electrical compartment. The aiming platforms may be located on a plurality of different planes within the optical compartment. A protective lens may be mounted to the housing to enclose the optical compartment. In some embodiments, the protective lens comprises a plurality of surfaces configured to be substantially parallel to the plurality of planes within the optical compartment.

DETAILED DESCRIPTION

Figure 1:
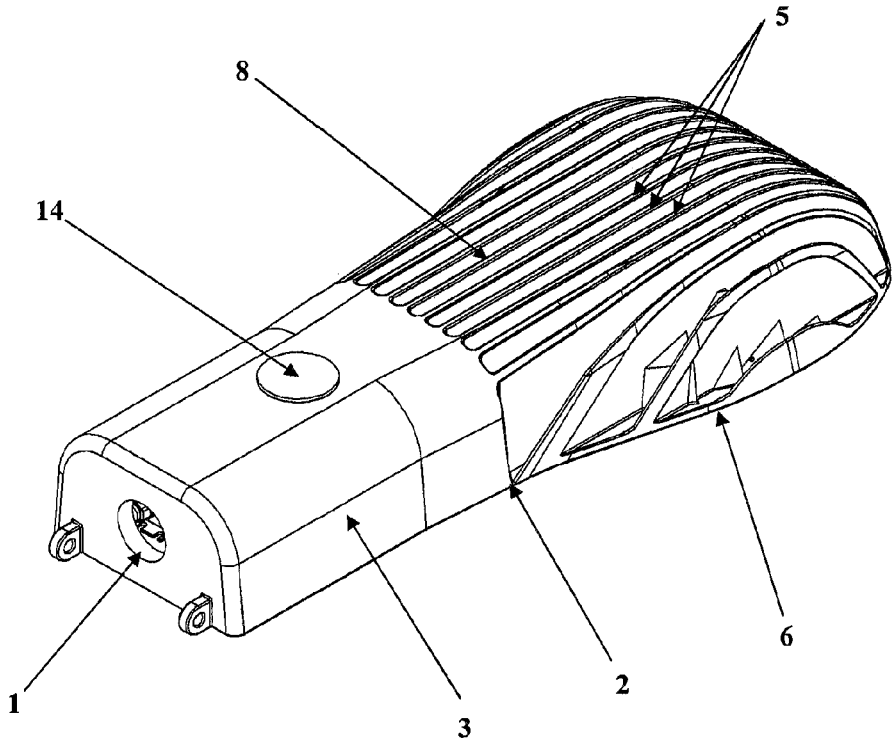
FIG. 1 is a top perspective view of an overhead lamp assembly of an exemplary embodiment.
Figure 2:
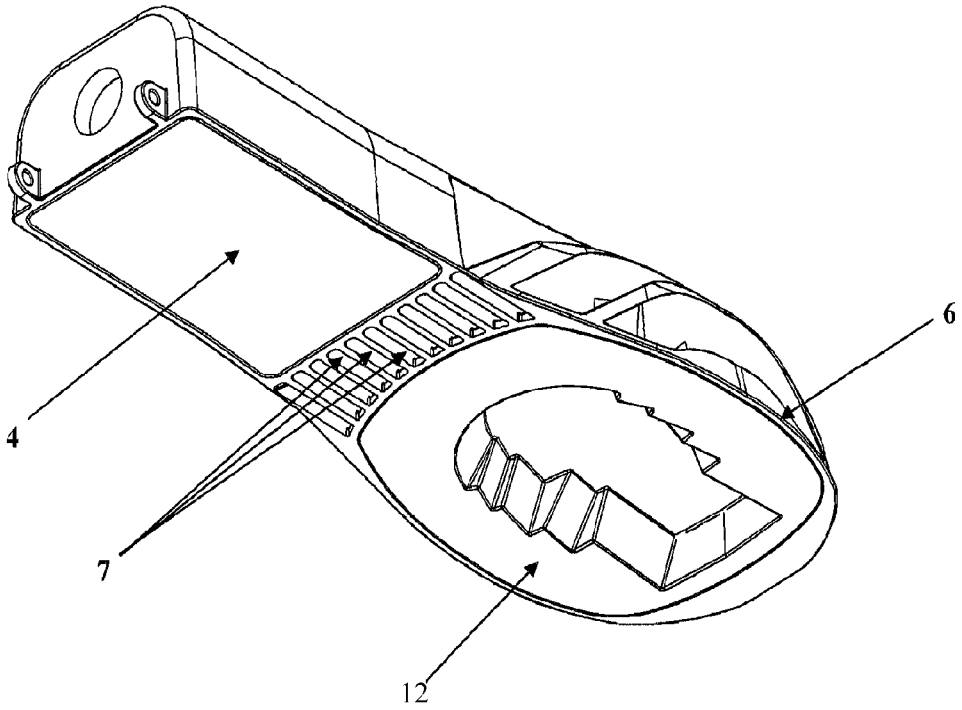
FIG. 2 is a bottom perspective view of an overhead lamp assembly of an exemplary embodiment.

In many street lighting applications, overhead lamp assemblies are used to provide illumination of a roadway surface, along with, in many cases, illumination of adjacent pedestrian and/or bicycle paths. Overhead street lights come in numerous different configurations, one common configuration referred to as a "cobra head," and is widely known by those of skill in the art. Traditional "cobra head" luminaires typically include a housing, a reflector, a light source (commonly a metal halide lamp) and a lens. The housing is mounted to a mast arm, which in turn is mounted to a pole placed in the area to be illuminated.

With the advance of light emitter diode (LED) based illumination systems, made possible by LED modules that produce relatively high intensity light output, lamp assembly construction using LED modules are desirable. This is because LED-based lamp assemblies can produce light output comparable to that of a metal halide lamp, or other traditional light source, while consuming a fraction of the electrical power and having a significantly longer lifetime before requiring replacement. Accordingly, while commonly having a higher up-front cost, the total lifetime costs of LED-based lamp assemblies can be significantly reduced as compared to lamp assemblies using traditional light sources. One potential method of upgrading traditional light sources to LEDs is to replace the reflector, the lamp and the lens with a retrofittable assembly that houses the LEDs and dissipates their heat, mounts the LEDs' aiming optics and the LEDs' power supply and also provides a protective external lens. This system of replacing traditional light sources has great value in circumstances where it is desired to retain the existing external housing. In circumstances where it is deemed advantageous to replace the housing, embodiments provided herein provide several significant advantages. In some instances, the advantages provided by certain embodiments may outweigh the need or desire to retain the old, existing housing.

In one exemplary embodiment, a unitary housing comprises a single casting with six main functions: (1) mechanical mounting for the housing itself, (2) protection for electrical components and connections, (3) thermal control, (4) aiming platforms for the LEDs, (5) protection for the LEDs and their individual lenses and (6) provisions for mounting decorative coverings or "skins" to accommodate different aesthetic requirements. Combining all these functions into a single casting provides cost advantages in both the manufacture of the luminaire and in its installation.

With reference now to FIGS. 1-5, a retrofit assembly of an exemplary embodiment is discussed. The assembly of this embodiment includes a mechanical mounting provided for by an opening 1 into the back of the casting 2. The mechanical mounting 1 is sized to accommodate standard mast arms, along with a universal slipfitter. In one another embodiment, the rear section is subdivided so that the mechanical mounting section is isolated from the electrical section so as to provide environmental protection.

Environmental protection for the electrical components and connections is provided by compartment 3 that is sealed with a door 4 that can be swung open to provide electrical access to electrical components therein. In this embodiment, thermal control is provided by heat sink fins 5 cast into the casting 2. The casting 2 may be formed of any suitable material, and in one embodiment is an aluminum alloy. The material of the casting 2, in other embodiments, may be some other metal, alloy, polymer or composite material that provides both sufficient strength and thermal conductivity. In the exemplary embodiment, the fins 5 are oriented along the long axis of the housing, joining and providing mechanical support from the mounting area 1 and electrical compartment 3 to an optical compartment 6. In the exemplary embodiment, vent holes or channels 7 are cast in place between the electrical compartment 3 and the optical compartment 6 to allow for convective airflow so as to enhance removal of heat generated by the light sources (such as LEDs) and thus keep the light sources at relatively cool operating temperature so as to enhance both their lumen output and their operational lifetime.

In this exemplary embodiment, the heat sink fins 8 run the length of the housing in a linear fashion. In another embodiment, the fins 8 run along the longest length of the housing in the center, while the fins along the sides of the optical section 6 are oriented orthogonally to the fins in the center in order to enhance water runoff and debris removal. In another embodiment, the fins are oriented in a radial fashion centered on or near the center of the optical compartment 6 with the fins running lengthwise between the optical compartment 6 and the electrical compartment 4. In further embodiments, the fins are oriented in other configurations, such as a combination of the above.

Figure 3:
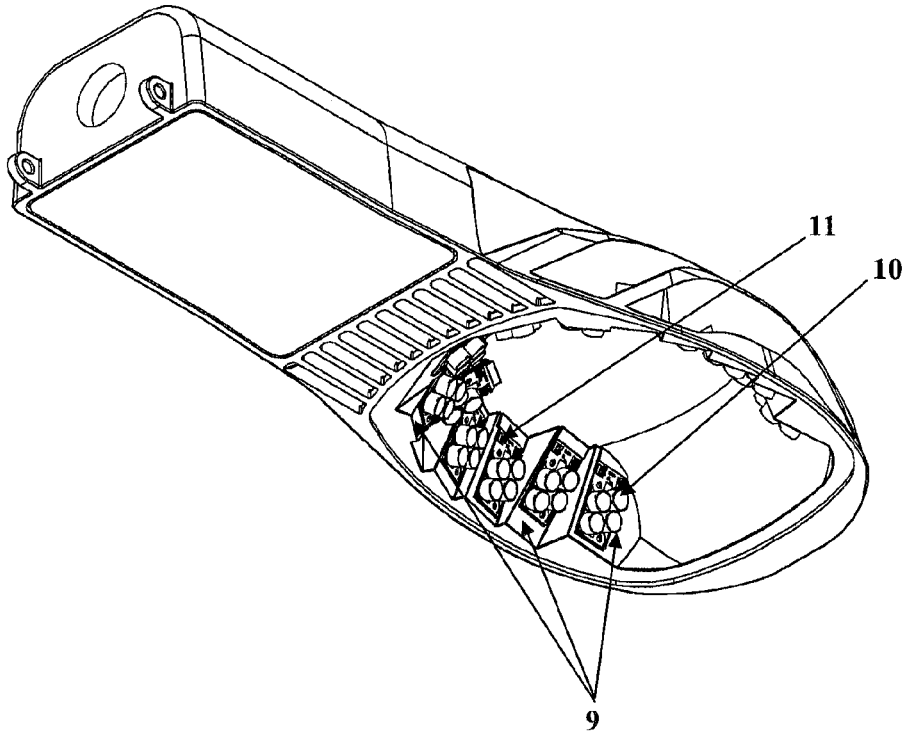
FIG. 3 is a bottom perspective view of an overhead lamp assembly of an exemplary embodiment with a protective bottom lens removed.
Figure 4:
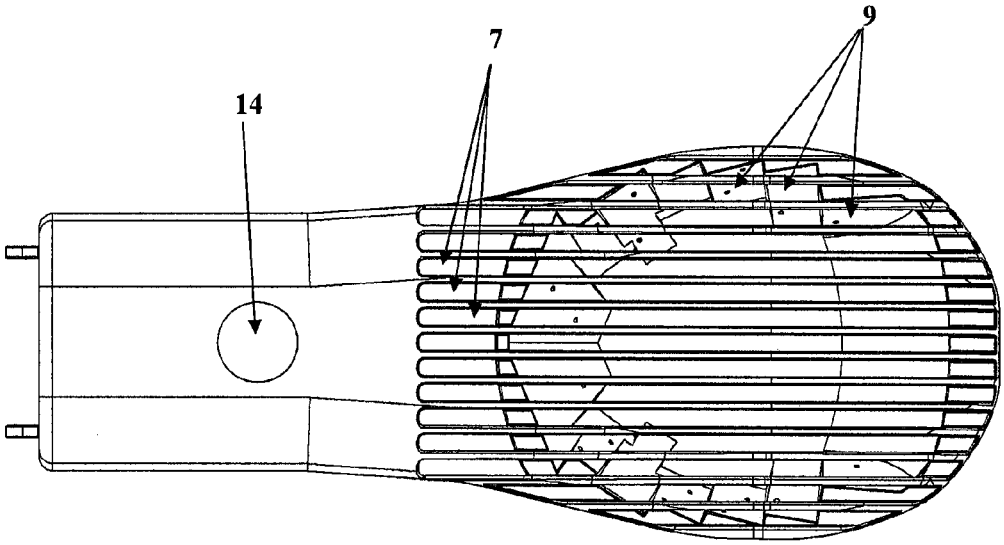
FIG. 4 is a top view of an overhead lamp assembly of an exemplary embodiment.
Figure 5:
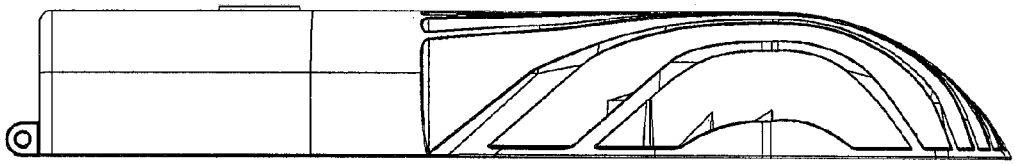
FIG. 5 is a side view of an overhead lamp assembly of an exemplary embodiment.

With specific reference to FIG. 3, aiming platforms 9 for the light sources are cast into the optical section 6 that houses the LEDs. In this embodiment, the light sources are LEDs 10 that are well known in the art and have one or multiple LED light elements and associated optics in the form of a lens that provides a desired output light beam. These aiming platforms 9 provide for orienting the LEDs 10 to allow for precisely directing each LED's 10 light output, along with the lenses over each LED, so as to optimally achieve the desired pattern of light on the ground. The aiming platforms 9 of this embodiment are part of the same casting as the heat sink fins 8 and provide enhanced thermal coupling from the aiming platforms 9 to the outside air. LEDs 10 are typically mounted on thermally conductive printed circuit boards (PCBs) 11, which are then mounted onto the aiming platforms 9, thus providing thermal control so that heat generated at the LEDs 10 is conducted away from the LEDs. In some embodiments, the PCBs 11 are mounted to the aiming platforms 9 with a thermally conductive epoxy which may be in addition to one or more screws, rivets, or other suitable physical connector.

Environmental protection for the LEDs 10 and their individual lenses is provided by a lens 12 (FIG. 2) covering the optical compartment 6. The lens 12 in this embodiment is recessed and configured to have recessed surfaces that correspond to the aiming platforms 9. However, it is to be understood that the lens 12 may have other configurations, and may be flat, recessed or extended as needed by the requirements of the application. In the embodiment of FIGS. 1-5, a recess is cast into the unitary housing to accommodate the lens 12. The embodiment of FIGS. 1-5 also include a standard photocell 14 that provides an indication of external ambient light used in controlling the illumination of LEDs 10.

Figures 6, 7:
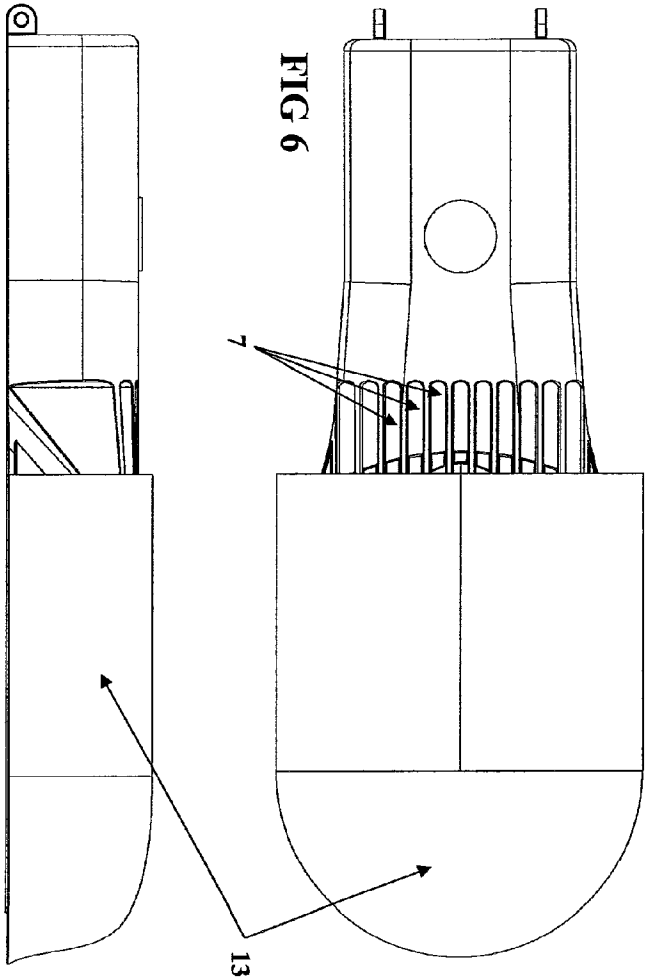
FIG. 6 is a top view of an overhead lamp assembly with an external decorative panel of an exemplary embodiment.
FIG. 7 is a side view of an overhead lamp assembly with an external decorative panel of an exemplary embodiment.
Figure 8:
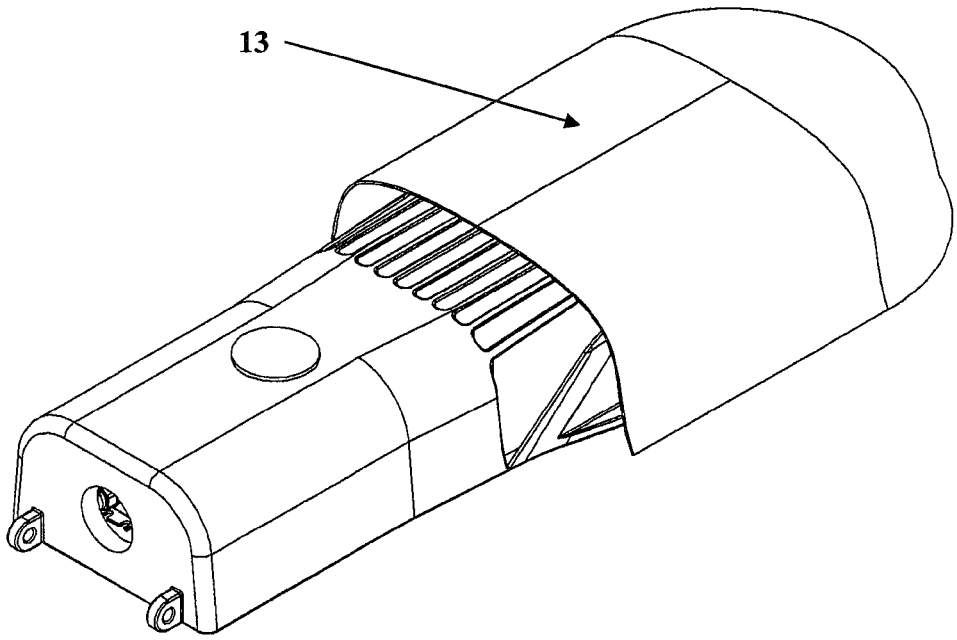
FIG. 8 is a top perspective view of an overhead lamp assembly with an external decorative panel of an exemplary embodiment.

In the embodiment of FIGS. 1-5, the unitary casting is shaped in an aesthetically pleasing fashion so that it may be installed as is in place of previous generation cobra head luminaires. However, because aesthetic requirements may vary widely, other embodiments provide external decorative panels or "skins" 13, such as illustrated in the embodiment of FIGS. 6-8. These skins 13 may be formed to match the outline of the casting, to match the outline of another cobra head, or formed to appear in nearly any shape that suits the particular user of the luminaire.

These skins 13 may be made of metal, polymer, wood, composite or some other material or combination of materials. In the exemplary embodiment of FIGS. 6-8, ventilation is provided by the construction of the skin so as to continue to allow natural convention to provide cooling. The skins may be whatever color is aesthetically required.

Such skins 13 may be passive (as in the embodiment of FIGS. 5-8) or they may be "active skins" having, for example, decorative lights embedded or otherwise attached. In one embodiment, LEDs are built into the skin and may be illuminated as decorative Christmas or other holiday lighting. Other embodiments provide control electronics to illuminate these LEDs in different patterns. In one embodiment, the outside skin LEDs are RGB LEDs that comprise a combination of Red, Green and Blue LEDs, generally in a single package, such that nearly any color of the rainbow may be displayed. The electronics within the electronics compartment 3 may be programmed to illuminate the active skin in the desired manner, and may include preset patterns selected through a switch in the electronics compartment 3. In such an embodiment, a user may simply access the electronics compartment and select the desired setting. In other embodiments, the electronics in the electronics compartment include a communications port that may send and/or receive communications from an external source that provides instructions for controlling light output by the luminaire. The communications port may include a wireless transceiver, and/or any suitable physical connection.

In another embodiment, messages may be displayed on the active skins. These messages may be traffic warnings, weather updates, advertisements or other information, which may be communicated via wireless or wired connection. The displaying of these messages may be set up to be a source of revenue for whichever municipality or entity controls the luminaire. On other embodiments, the active skins may include LEDs that are mounted and aimed so as to provide illumination, or supplemental illumination, to, for example, sidewalks adjacent to the roadway.

Figure 9:
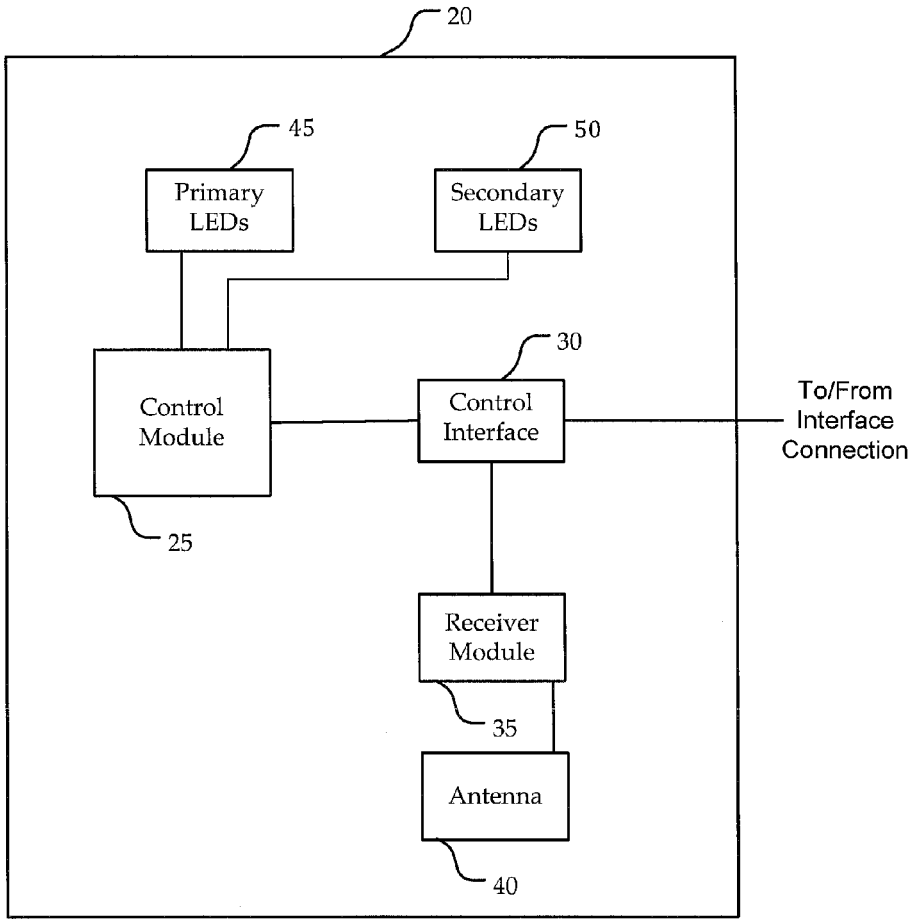
FIG. 9 is a block diagram illustration of an electrical module of an exemplary embodiment.

With reference now to FIG. 9, a block diagram illustration of the electrical module 20 within the electrical compartment is described. The electrical module is interconnected to a power input and includes a power supply, such as is well known in the art and is not illustrated in FIG. 9. In this embodiment, a control module 25 performs functions for the control and operation of the LED modules of the luminaire assembly. The control module 25 may include a photocell, such as photocell 14 as described above, that detects ambient light. A control interface 30 is included in this example, which includes an interface to a receiver module 35 and an antenna 40, and an interface to/from an interface connection such as a serial port. The receiver module 35 of various embodiments may operate using any of a number of different wireless protocols, such as IEEE 801.11, Bluetooth, and/or any cellular protocols, for example. Primary LEDs 45 located in the housing, and any secondary LEDs 50 such as on active skins, are controlled by the control module 25. Thus, a user may reprogram the electrical module to activate the LEDs according to a program that may be uploaded to the module through the control interface.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An overhead street luminaire apparatus, comprising:

a unitary housing comprising a mechanical mounting structure, an electrical compartment; a plurality of heat dissipation devices; a plurality aiming platforms; and an optical compartment in a cavity of the housing adjacent to the electrical compartment, and wherein the aiming platforms are located on a plurality of different planes within the optical compartment;

a plurality of light emitting diode (LED) modules, each mounted to an aiming platforms;

a control module located within the electrical compartment and coupled to the LED modules, and configured to control the operation of the LED modules; and a protective lens mounted to the housing to enclose the optical compartment, wherein the protective lens comprises a plurality of surfaces configured to be substantially parallel to the plurality of planes within the optical compartment.

2. The apparatus of claim 1, further comprising:

a decorative covering mounted to the unitary housing.

3. The apparatus of claim 2, wherein the decorative covering comprises one or more secondary light emitting diodes that are coupled to the control module, and wherein the control module is further configured to control the operation of the secondary light emitting diodes.

4. The apparatus of claim 3, wherein the control module is configured to be programmed to cause the secondary light emitting diodes to activate and deactivate in a predetermined sequence.

5. The apparatus of claim 4, wherein the controller interface is adapted to receive programming instructions via a wireless communications interface.

6. The apparatus of claim 1, wherein the unitary housing comprises a housing formed of a single casting.

7. The apparatus of claim 6, wherein the single casting is an aluminum casting.

8. The apparatus of claim 1, wherein the heat dissipation devices comprise a plurality of transversely oriented heat dissipation fins.

9. The apparatus of claim 1, wherein the LED modules are mounted to the aiming platforms with a heat conducting epoxy.

10. The apparatus of claim 9, wherein the aiming platforms are connected to the heat dissipation devices, thereby providing a conductive thermal path between the LED modules and the heat dissipation devices.

11. The apparatus of claim 4, further comprising a controller interface coupled to the control module and adapted to receive programming instructions for the control module.

* * * * *